US009500172B2

(12) United States Patent
Gray et al.

(10) Patent No.: US 9,500,172 B2
(45) Date of Patent: Nov. 22, 2016

(54) STARTER SYSTEM

(71) Applicant: REMY TECHNOLOGIES, LLC, Pendleton, IN (US)

(72) Inventors: Joel Gray, Fishers, IN (US); Kirk Neet, Pendleton, IN (US)

(73) Assignee: Remy Technologies, LLC, Pendleton, IN (US)

( * ) Notice: Subject to any disclaimer, the term of this patent is extended or adjusted under 35 U.S.C. 154(b) by 848 days.

(21) Appl. No.: 13/676,010

(22) Filed: Nov. 13, 2012

(65) Prior Publication Data

US 2013/0133604 A1 May 30, 2013

Related U.S. Application Data

(60) Provisional application No. 61/558,666, filed on Nov. 11, 2011.

(51) Int. Cl.
*F02N 11/08* (2006.01)
*F02N 15/06* (2006.01)

(52) U.S. Cl.
CPC ..... *F02N 11/08* (2013.01); *F02N 11/087* (2013.01); *F02N 11/0851* (2013.01); *F02N 15/067* (2013.01); *F02N 2011/0892* (2013.01)

(58) Field of Classification Search
CPC .. F02N 11/08; F02N 11/0851; F02N 11/087; F02N 15/067; F02N 2011/0892
See application file for complete search history.

(56) References Cited

U.S. PATENT DOCUMENTS

| | | | | |
|---|---|---|---|---|
| 2,020,749 | A * | 11/1935 | Watson | F02N 11/08 290/37 R |
| 7,218,010 | B2 * | 5/2007 | Albertson | F02N 11/0855 290/38 R |
| 2005/0099009 | A1 * | 5/2005 | Spellman | F02N 11/0851 290/38 R |
| 2013/0141192 | A1 * | 6/2013 | Neet | H01H 9/00 335/126 |
| 2013/0221682 | A1 * | 8/2013 | Bradfield | F02N 11/0855 290/38 C |
| 2013/0221683 | A1 * | 8/2013 | Bradfield | F02N 11/0851 290/38 R |

* cited by examiner

*Primary Examiner* — Hieu T Vo
*Assistant Examiner* — Sherman Manley
(74) *Attorney, Agent, or Firm* — Greenberg Traurig LLP

(57) ABSTRACT

Some embodiments of the invention provide a starter system including a starter, capable of being in communication with an electronic control unit. The starter can include a motor coupled to a circuit and a pinion including a plunger, and a plurality of solenoid assemblies that includes a plurality of biasing members. The plurality of solenoid assemblies can include at least one solenoid winding capable of moving the plunger to move the pinion, and at least one solenoid assembly capable of controlling current flow to the motor. Some embodiments include a first switch coupled to the circuit. In some embodiments, the first switch is capable of being activated by the plunger to cause current to flow, or to prevent current flowing to at least a portion of the circuit.

21 Claims, 7 Drawing Sheets

STARTER SYSTEM

RELATED APPLICATIONS

This application claims priority under 35 U.S.C. §119 to U.S. Provisional Patent Application No. 61/558,666 filed on Nov. 11, 2011, the entire content of which is incorporated herein by reference.

BACKGROUND

Some electric machines can play important roles in vehicle operation. For example, some vehicles can include a starter, which can, upon a user closing an ignition switch, lead to cranking of engine components of the vehicle. Drive train systems capable of frequent start and stop conditions are a further requirement in modern vehicles. Frequent start-stop conditions require the starter to operate at high efficiency both at cold engine crank and warm engine crank environments. The demands of frequent start-stop conditions require various components and systems that function more rapidly and more efficiently to increase reliability, reduce energy consumption and enhance the driving experience. Some starters can include a one or more sensor assemblies for detection of various functional components of the start motor, and a control system capable of directing various functional components of the starter system to enable reliable, synchronous engagement. Some starter motors can include a field assembly that can produce a magnetic field to rotate some starter motor components. Some starter motors can include one or more field assemblies that can produce a magnetic field to translate some starter motor components.

SUMMARY

Some embodiments of the invention provide a starter that can perform well at high-speeds having low torque demand while also operating well at low speeds having high torque demanded of the starter. In some embodiments, the starter is able to meet the cold crank requirement and function under a warm start scenario while reducing the pinion speed at low pinion torque. In conjunction with this operating parameter, some embodiments of the invention provide components and systems that are configured and arranged to function to allow better engagement of the starter system with the drivetrain of the vehicle.

Some embodiments of the invention provide a starter system comprising a starter capable of being controlled by an electronic control unit. In some embodiments, the starter can include a motor coupled to a circuit, a plurality of solenoid assemblies, and a plunger moveably coupled to a pinion.

In some embodiments, the motor and the plurality of solenoid assemblies is configured and arranged to be capable of being controlled by an electronic control unit. In some embodiments, the plunger is configured and arranged to be electromagnetically coupled to at least one solenoid assembly.

In some embodiments, a solenoid assembly can include a plunger-return biasing member and at least two solenoid windings at least partially circumscribing the plunger. In some embodiments, the solenoid windings are configured and arranged to alternately move and to prevent motion of the plunger, and in some embodiments, the resistance of the second set of solenoid windings is greater than the resistance of the first set of solenoid windings.

Some embodiments of the circuit include a first switch capable of actuation by the plunger. In some embodiments, the first switch comprises at least two contacts capable of electrical coupling with the motor, and is configured and arranged to actuate under the influence of the plunger to either cause current to flow, or to prevent current flow. In some embodiments, the at least two contacts can couple with a coupling member that is integral to the first switch. In some other embodiments, the coupling member comprises the plunger. In some embodiments, the movement of the plunger and coupling with the at least two contacts enables the flow of current through the first switch. In some other embodiments, movement of the plunger and decoupling from the contacts prevents the flow of current through the first switch.

Some embodiments provide a secondary solenoid assembly comprising a secondary coil winding at least partially circumscribing a secondary plunger, and is configured and arranged to electrically couple with a set of secondary solenoid assembly contacts. In some embodiments, the secondary solenoid winding can be configured and arranged to move the secondary plunger to couple and decouple with a set of secondary solenoid assembly contacts to control current to flow to the motor.

Some embodiments of the circuit include at least one pin coupled to the circuit capable of controlling a current flow to at least one other component in the circuit under control from an electronic control unit. In other embodiments, a switch can be further coupled to the circuit. In some embodiments, the switch can be controlled by an electronic control unit. In some embodiments, the circuit can include at least one magnetic switch.

In some embodiments, one or more pins can control the flow of current to one or more solenoid windings independently.

DETAILED DESCRIPTION

Figure 1:
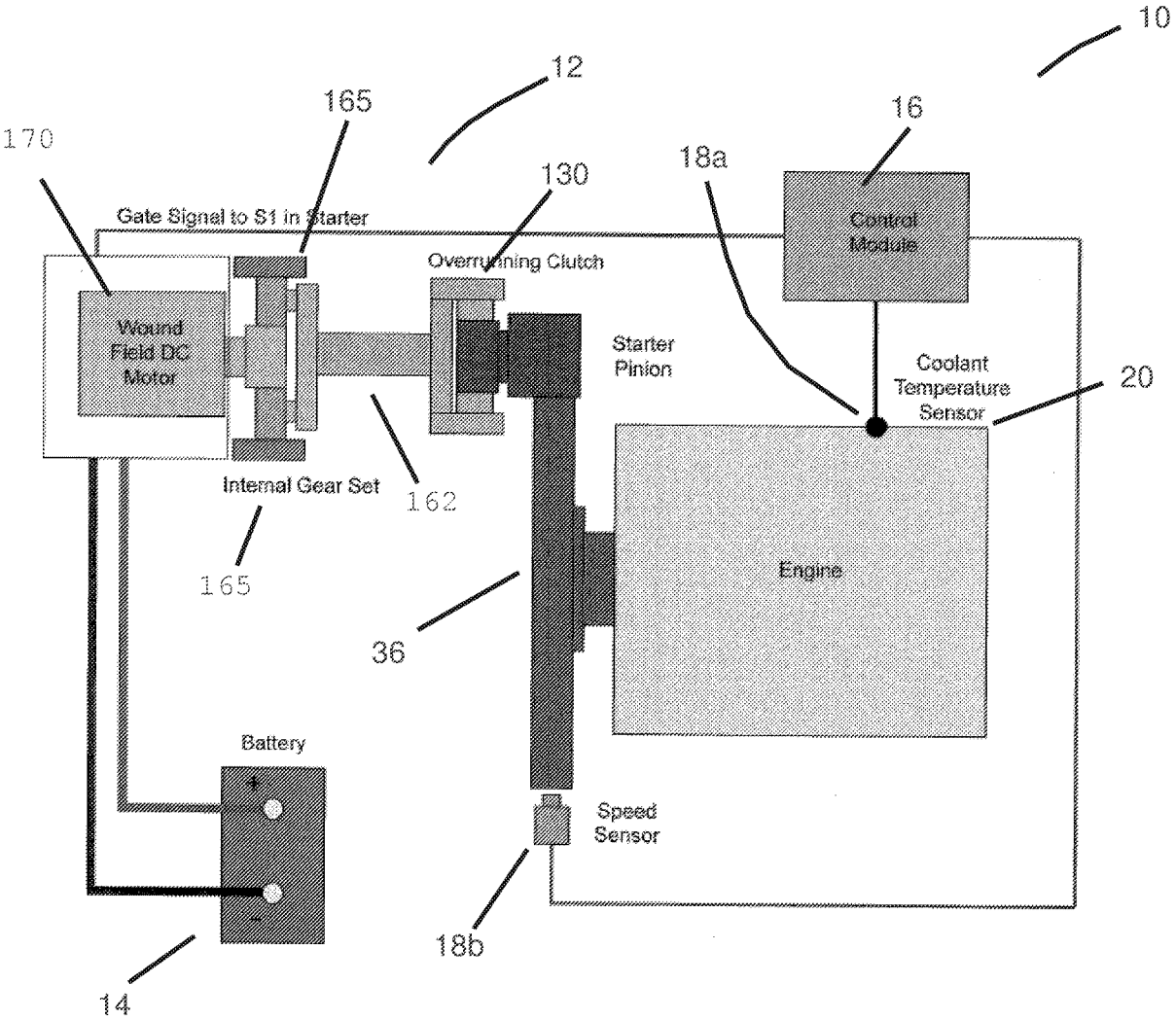
FIG. 1 is a diagram of a machine control system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising,"

or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a starter control system 10 according to one embodiment of the invention. The system 10 can include an electric machine, a power source 14, such as a battery, a control module 16, one or more sensors 18*a* and 18*b*, and an engine 20, such as an internal combustion engine. In some embodiments, a vehicle, such as an automobile, can comprise the system 10, although other vehicles can include the system 10. In some embodiments, non-mobile apparatuses, such as stationary engines, can comprise the system 10.

In addition to the conventional engine 20 starting episode (i.e., a "cold start" starting episode), the starter control system 10 can be used in other starting episodes. In some embodiments, the control system 10 can be configured and arranged to enable a "stop-start" starting episode. For example, the control system 10 can start an engine 20 when the engine 20 has already been started (e.g., during a "cold start" starting episode) and the vehicle continues to be in an active state (e.g., operational), but the engine 20 is automatically temporarily inactivated (e.g., the engine 20 has substantially or completely ceased moving at a stop light).

Moreover, in some embodiments, in addition to, or in lieu of being configured and arranged to enable a stop-start starting episode, the control system 10 can be configured and arranged to enable a "change of mind stop-start" starting episode. The control system 10 can start an engine 20 when the engine 20 has already been started by a cold start starting episode and the vehicle continues to be in an active state and the engine 20 has been automatically deactivated, but continues to move (i.e., the engine 20 is coasting). For example, after the engine 20 receives a deactivation signal, but before the engine 20 substantially or completely ceases moving, the user can decide to reactivate the engine 20 (i.e. vehicle operator removes his foot from the brake pedal) so that the pinion 150 engages the ring gear 36 as the ring gear 36 is coasting. After engaging the pinion 150 with the ring gear 36, the motor 170 can restart the engine 20 with the pinion 150 already engaged with the ring gear 36. In some embodiments, the control system 10 can be configured for other starting episodes, such as a conventional "soft start" starting episodes (e.g., the motor 170 is at least partially activated during engagement of the pinion 150 and the ring gear 36).

The following discussion is intended as an illustrative example of some of the previously mentioned embodiments employed in a vehicle, such as an automobile, during a starting episode. However, as previously mentioned, the control system 10 can be employed in other structures for engine 20 starting.

As previously mentioned, in some embodiments, the control system 10 can be configured and arranged to start the engine 20 during a change of mind stop-start starting episode. For example, after a user cold starts the engine 20, the engine 20 can be deactivated upon receipt of a signal from the engine control unit 16 (e.g., the vehicle is not moving and the engine 20 speed is at or below idle speed, the engine control unit 16 instructs the engine 20 to inactivate after the vehicle user depresses a brake pedal for a certain duration, etc.), the engine 20 can be deactivated, but the vehicle can remain active (e.g., at least a portion of the vehicle systems can be operated by the power source 14 or in other manners). At some point after the engine 20 is deactivated, but before the engine 20 ceases moving, the vehicle user can choose to restart the engine 20 by signaling the engine control unit 16 (e.g., via releasing the brake pedal, depressing the acceleration pedal, etc.) which will cause the pinion 150 to be automatically engaged with the ring gear 36. For example, in order to reduce the potential risk of damage to the pinion 150, and/or the ring gear 36, a speed of the pinion 150 (the pinion speed multiplied by the ring/pinion gear ratio) can be substantially synchronized with a speed of the ring gear 36 (i.e., a speed of the engine 20) when the starter 12 attempts to engage the pinion 150 with the ring gear 36. The engine control unit 16 can then use at least some portions of the starter control system 10 to restart the engine 20.

Figure 2:
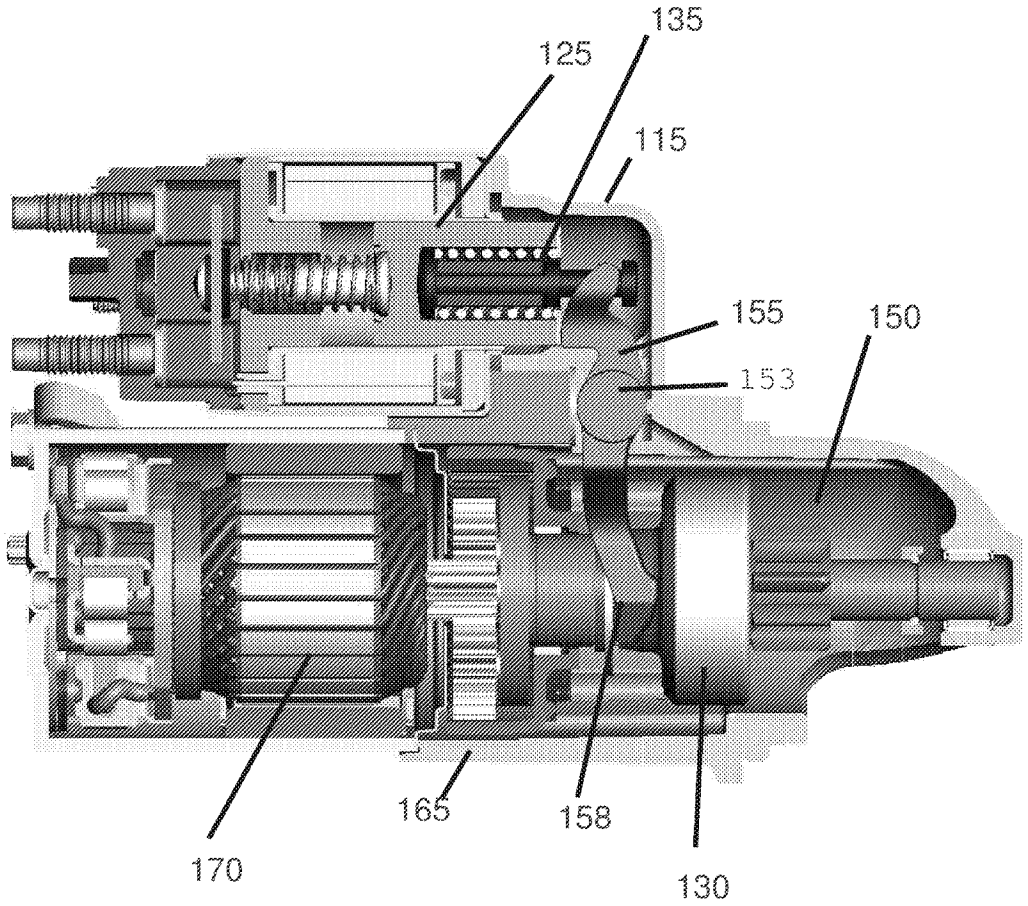
FIG. 2 is cross-sectional view of a conventional starter.

As shown in FIG. 2, in some embodiments, the electric machine can comprise a starter 12. In some embodiments, the starter 12 can comprise a housing 115, a gear train 165, a brushed or brushless motor 170, a solenoid assembly 125, an over-running clutch 130, and a pinion 150. In some embodiments, the starter 12 can operate in a generally conventional manner. For example, in response to a signal (e.g., a user closing a switch, such as an ignition switch 315), circulation of a current through the solenoid assembly 125 can cause a plunger 135 to move the pinion 150 into an engagement position (e.g., an abutment position and/or an engaged position) with a ring gear 36 of a crankshaft of the engine 20. Further, the same or another signal can lead to the motor 170 generating an electromotive force, which can be translated through the gear train 165 to the pinion 150 engaged with the ring gear 36. As a result, in some embodiments, the pinion 150 can crank the engine 20, which can lead to engine ignition. Further, in some embodiments, the over-running clutch 130 can aid in reducing a risk of damage to the starter and the motor 170 by disengaging the pinion 150 from a shaft 162 connecting the pinion 150 and the motor 170 (e.g., allowing the pinion 150 to free spin if it is still engaged with the ring gear 36). In some embodiments, the pinion 150 can be directly coupled to a shaft of the motor 170 and can function without a gear train 165.

Figure 3A:
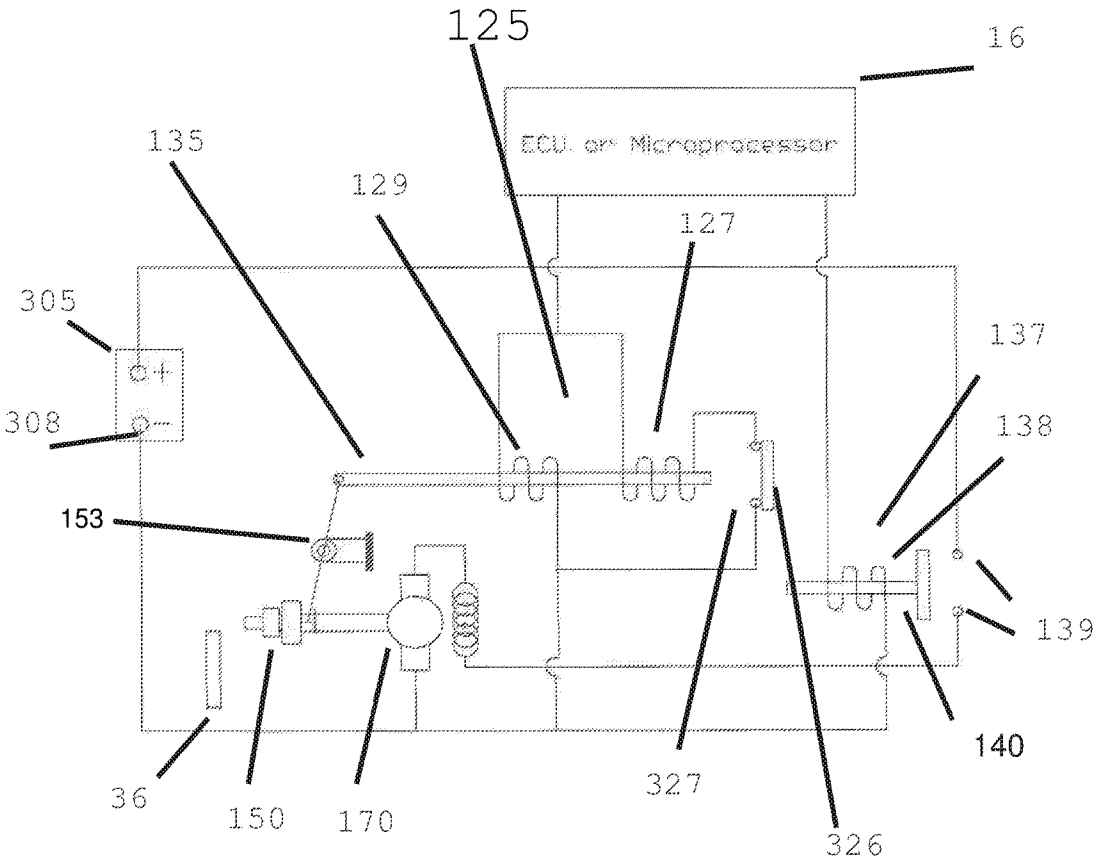
FIG. 3A is circuit diagram representing portions of a starter control system according to one embodiment of the invention.
Figure 3B:
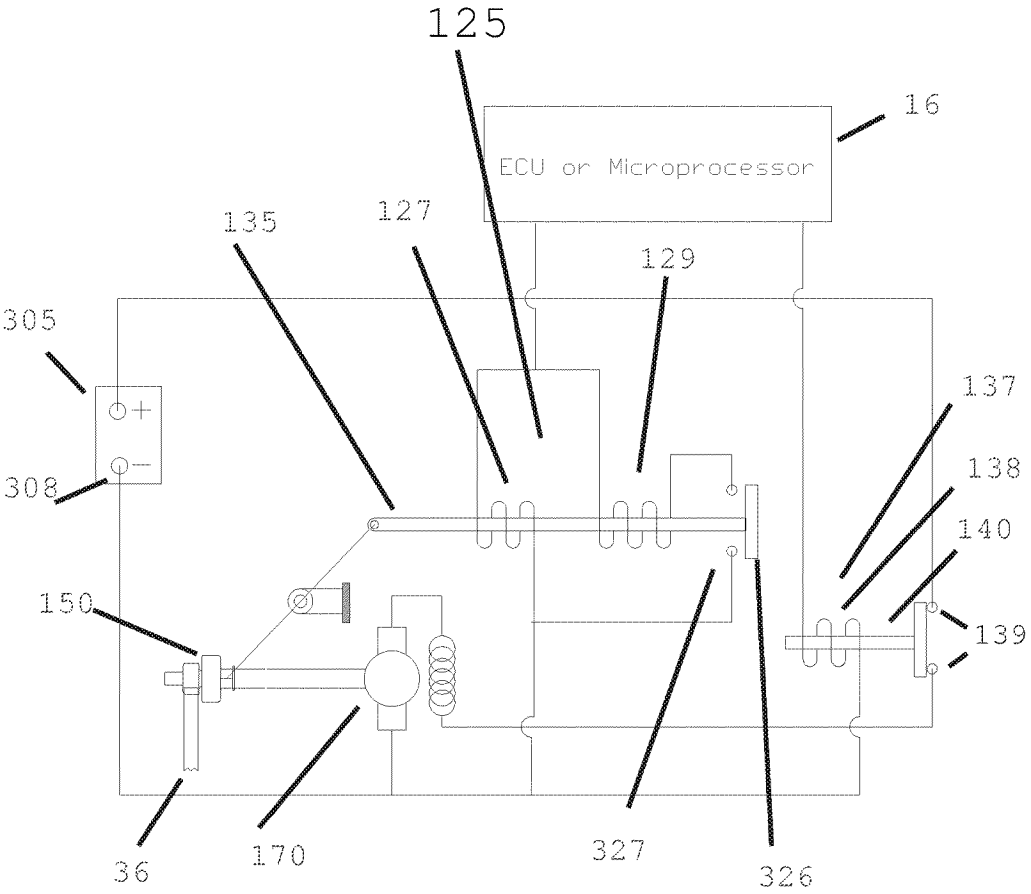
FIG. 3B is circuit diagram representing portions of a starter control system according to one embodiment of the invention.
Figure 3C:
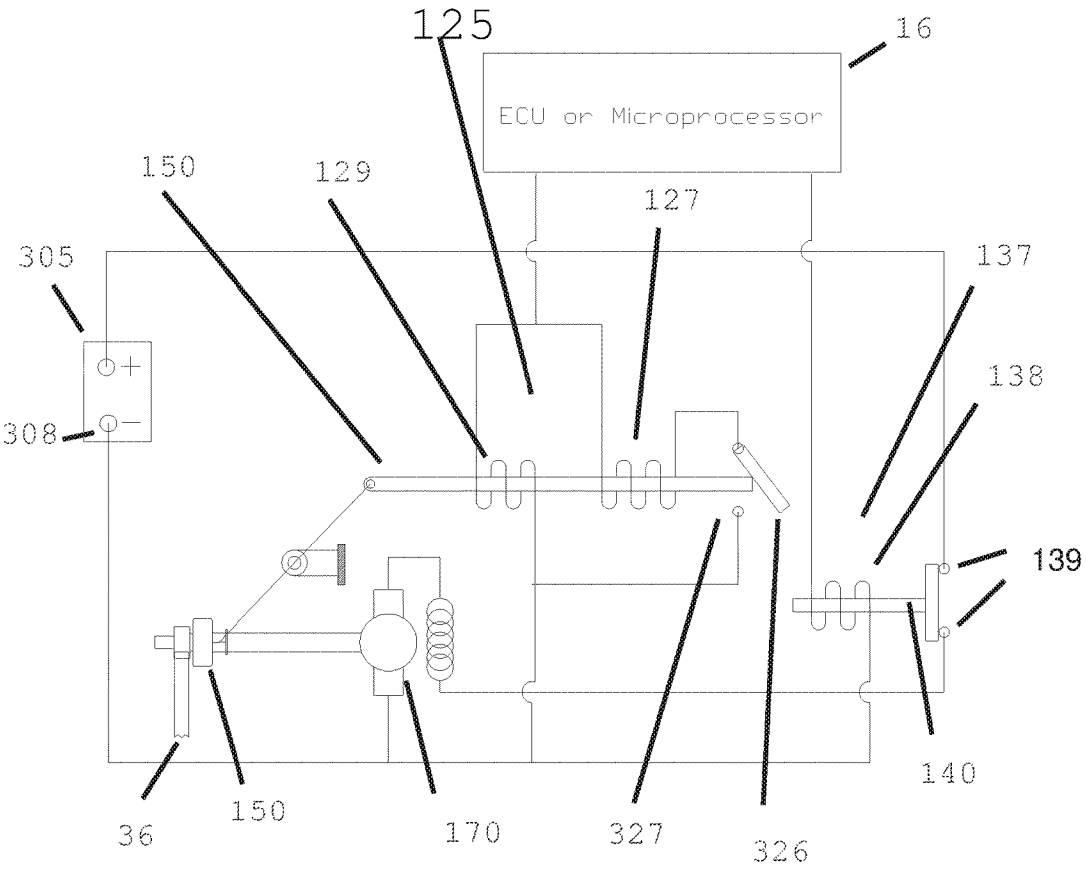
FIG. 3C is circuit diagram representing portions of a starter control system according to one embodiment of the invention.

In some embodiments, the solenoid assembly 125 can comprise one or more sets of solenoid windings. For example, as depicted in FIGS. 3A-3C, the solenoid assembly 125 can comprise a first set solenoid windings 127 and a second set of solenoid windings 129. Moreover, in some embodiments, the starter 12 (e.g., the solenoid assembly 125) can include a plunger 135 operatively coupled to a shift lever 153, including a first end 155 and a second end 158.

The shift lever 153 can be coupled to the pinion 150. As a result, in some embodiments, by activating one or more of the solenoid windings 127, 129, the plunger 135 can be moved (e.g. drawn inward or pushed outward) by at least a portion of the magnetomotive force generated by the windings 127,129 and at least a portion of the movement created can be translated to engage of the pinion 150 and the ring gear 36.

In some embodiments, the first and second sets of solenoid windings 127, 129 can comprise different functions. In some embodiments, the first set of solenoid windings 127 can be configured and arranged to move the plunger 135. For example, after the user closes the circuit (e.g., via closing the ignition switch 315), current can flow through the first set of solenoid windings 127 to at least partially energize the first set of windings 127. As a result, the plunger 135 can move (e.g., be drawn inward through the first set of solenoid windings 127), which can cause the shift lever 153 to move the pinion 150 into engagement with the ring gear 36. In some embodiments, the second set of solenoid windings 129 can function to at least partially retain the plunger 135 in a desired position. For example, upon energization, the first set of solenoid windings 127 can function to move the plunger 135 from a first position (e.g., where the plunger 135 is biased via a spring force when little to no current flows through the first or second set of solenoid windings 129) to a second position (e.g., where the plunger 135 moves the shift lever 153 to cause the pinion 150 to engage the ring gear 36). Moreover, in some embodiments, the second set of solenoid windings 129 can also function to move the plunger 135 from the first position to the second position, in lieu of or in addition to the first set of solenoid windings 127. In some embodiments, the first set of solenoid windings 127 can be substantially or completely de-energized and the second set of solenoid windings 129 can be energized or remain energized to retain the plunger 135 in the second position. The second set of windings 129 can comprise a greater resistance and, as a result, a lesser current relative to the first set of solenoid windings 127. In some embodiments, after the engine 20 has been started, the second set of solenoid windings 129 can be substantially or completely de-energized and a spring force (not shown) can move the plunger 135 back to the first position.

In some embodiments, similar to conventional solenoid assemblies, the circulation of current through the first and second sets of solenoid windings 127,129 can cause the plunger 135 to move due to magnetomotive force. For example, the solenoid assembly 125 can be configured and arranged so that the plunger 135 is drawn within the first 127 and/or second set of solenoid windings 129 as shown in FIGS. 3A-3C, so that the windings 127,129 substantially circumscribe at least a portion of the plunger 135. Moreover, in some embodiments, the plunger 135 can comprise a plurality of sizes (e.g., multiple diameters, etc.) In some embodiments, as the plunger 135 moves through the first and second sets of solenoid windings 127,129 toward the second position, a distance between the plunger 135 and the windings 127,129 becomes smaller. For example, a size of an air gap between the plunger 135 and windings 127,129 becomes lesser as the plunger 135 axially moves through the solenoid assembly 125 because portions of the plunger 135 with a greater size (e.g., circumference) pass through windings 127,129 as the plunger 135 axially moves. In some embodiments, lesser amounts of magnetomotive force are necessary to move the plunger 135 as the air gap becomes lesser in size.

In some conventional starters, an end portion of the plunger 135 can engage a set of contacts to close a circuit that can route current from the power source 14 to the motor 170 to start the engine 20 (e.g., transfer torque via the pinion 150 to the ring gear 36) when the plunger 135 is in the second position. Moreover, before and/or after the plunger 135 reaches the second position, the second set of solenoid windings 129 can become at least partially energized to retain the plunger 135 in position (e.g., the second set of solenoid windings 129 can function to hold the plunger 135 in the second position) and/or to complete the movement of the plunger 135 toward the second position. As a result of the plunger 135 being retained in the second position by the solenoid windings 129, current can continue to flow through the contacts and to the motor 170, which can lead to starting of the engine 20, similar to some previously described embodiments.

Figure 4:
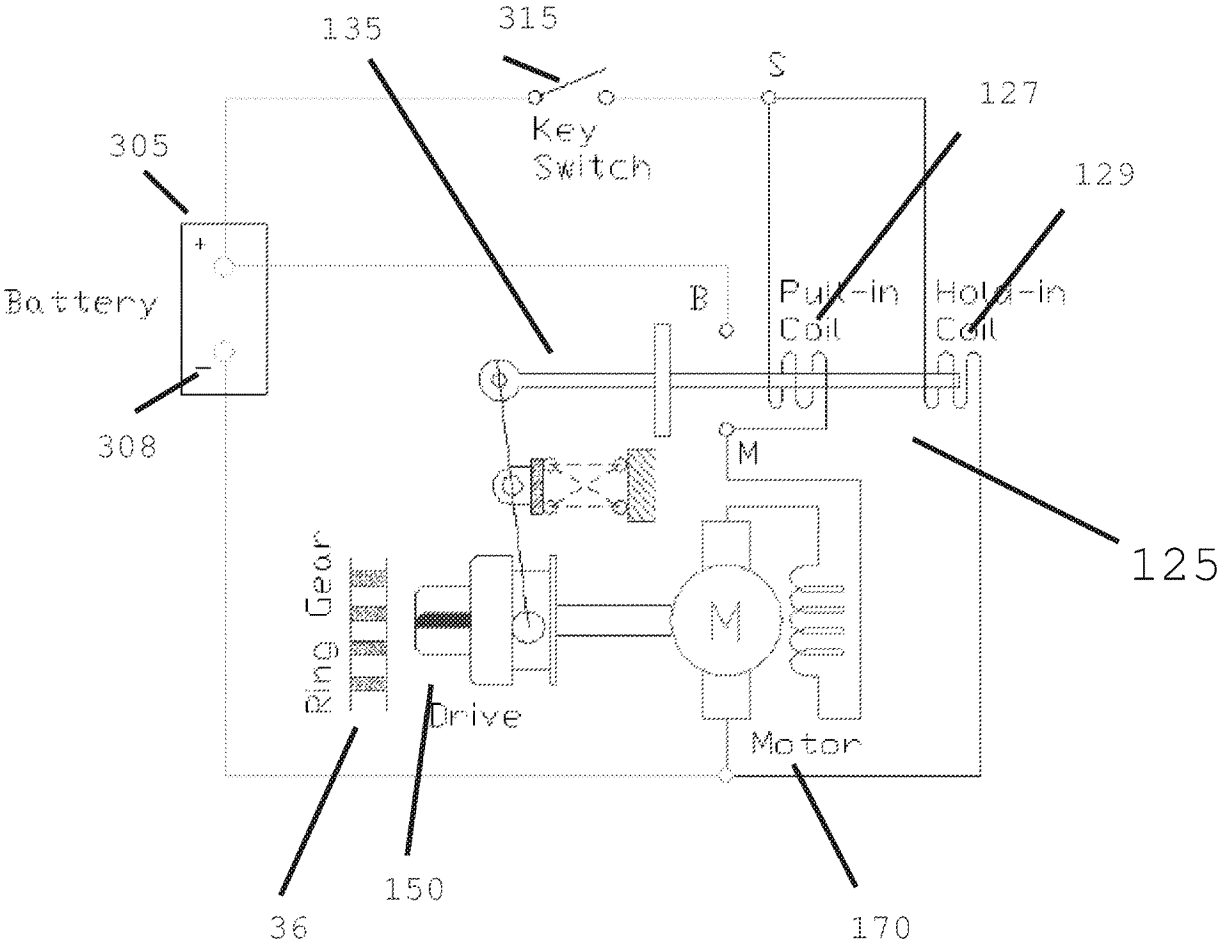
FIG. 4 is a circuit diagram representing portions of a conventional starter control system.

In some conventional starters, the first set of solenoid windings 127 can be at least partially inactivated by movement of the plunger 135. As shown in FIG. 4, when the plunger 135 engages the contacts, the first set of solenoid windings 127 can be substantially prevented from functioning. For example, by engaging the contacts, the plunger 135 can disable (e.g., "short circuit") the first set of solenoid windings 127 and the second set of solenoid windings 129 can function to retain the plunger 135 in position because of the reduced need for magnetomotive force, as previously mentioned. The first and the second sets of solenoid windings 127,129 can also be activated and deactivated at the same time.

In some embodiments, the solenoid assembly 125 can comprise multiple configurations. Referring to FIGS. 3A-3C, in some embodiments, at least one of the sets of solenoid windings 127,129 can be reversibly coupled to ground through contacts of a first switch 327. As shown in FIGS. 3A-3C, the first switch 327 is shown as being in between solenoid winding 127 and ground, and is therefore capable of operating as a ground switch, In some other embodiments, the switch 327 could also be placed in between the solenoid winding 127 and the pin P2, enabling functions other than operating as a ground switch. For example, as shown in FIGS. 3A-3C and 5, in some embodiments, a contactor or other coupling member 326 can be disposed between two contacts to electrically couple the first set of solenoid windings 127 to ground. In some embodiments, movement of the plunger 135 toward the second position, via magnetomotive force produced by the solenoid windings 127,129, can at least partially move the coupling member 326 that is disposed between the contacts. As a result of the plunger 135 moving the coupling member 326, the connection between the first set of solenoid windings 127 and ground, or the connection between the solenoid winding 127 and the pin P2, can be disrupted, and, accordingly, current will substantially or completely cease flowing through the first set of solenoid windings 127. Moreover, the first set of solenoid windings 127 cease producing magnetomotive force when the flow of current ceases. The second set of solenoid windings 129 can continue to move the plunger 135 and retain the plunger 135 in position after current ceases to flow through the first set of solenoid windings 127. In some embodiments, the contactor or coupling member 326 can comprise a spring-loaded configuration that can be free to move in a translational manner, as shown in FIG. 3B or can comprise a spring-loaded configuration that can be free to move in a generally rotational manner (e.g., one portion of the contactor or coupling member 326 can remain substantially stationary and another portion can move), as shown in FIG. 3C.

Figure 5:
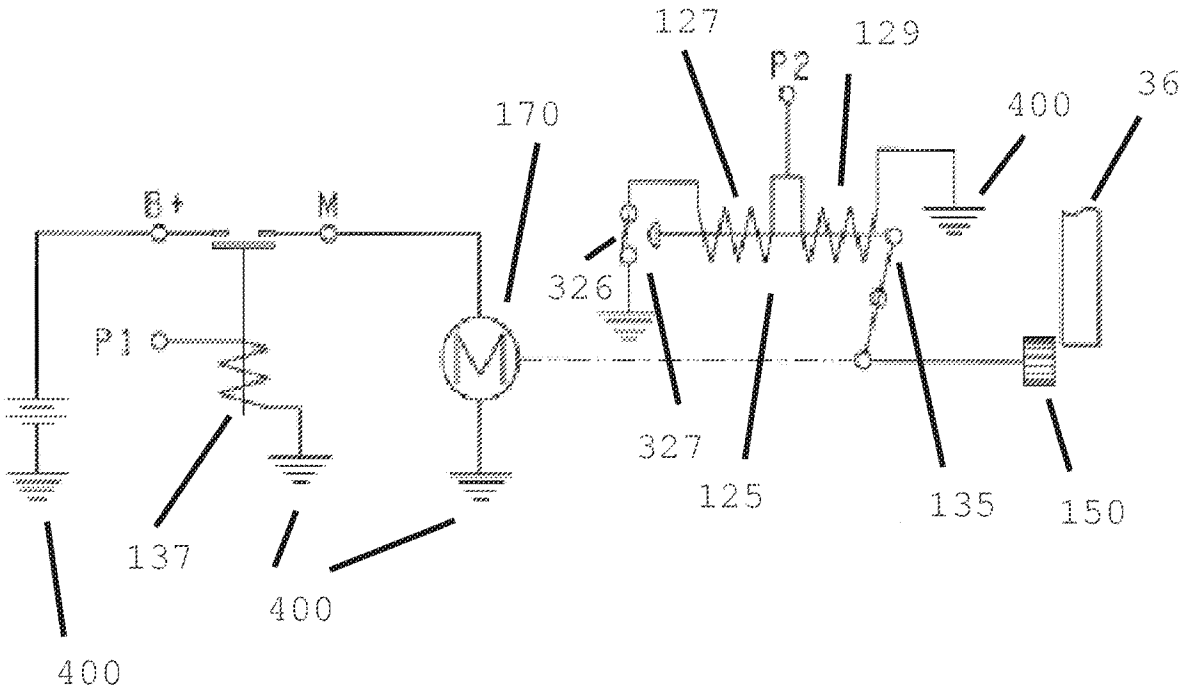
FIG. 5 is a circuit diagram representing portions of a starter control system according to one embodiment of the invention.

In some embodiments, the starter 12 can comprise a secondary solenoid assembly 137, as shown in FIGS. 3 and 5. In some embodiments, the secondary solenoid assembly 137 can comprise a portion of the previously-mentioned solenoid assembly 137, and, in other embodiments, the secondary solenoid assembly 137 can be coupled to the housing 115 and/or other portions of the starter 12 and in electrical communication with other elements of the starter control system 10, as shown in FIG. 3. Furthermore, in some embodiments, the secondary solenoid assembly 137 can comprise one or more magnetic switches.

In some embodiments, the secondary solenoid assembly 137 can comprise a set of secondary solenoid windings 138 and a second plunger 140 and a set of secondary solenoid assembly contacts 139. As described in further detail below, in some embodiments, upon passing current through the secondary solenoid windings 138, the second plunger can move toward the set of secondary solenoid assembly contacts 139, which, upon engagement with the plunger 140, can close at least a portion of a circuit to enable current flow to the motor 170 of the starter 12 to begin rotating the motor 170.

In some embodiments, the solenoid assembly 125 and secondary solenoid assembly 137 can be electrically coupled to the control module 16. For example, the control module 16 can comprise an electronic control module 16 or a microprocessor in communication with the sensors 18*a*, 18*b* disposed throughout the starter control system. In some embodiments, the two or more pins (e.g., P1 and P2 in FIG. 5 can at least partially provide for a gateway for current passing from a current source (e.g., the battery 14) when the signals are received from the electronic control module 16. For example, in some embodiments, signals can be sent from the electronic control module 16 that a starting event must occur. As a result, signals from the electronic control module 16 can be energized and current can flow from the current source through the pins P1 and P2 to the solenoid assembly 125 and/or the secondary solenoid assembly 137 to function as previously mentioned. In some embodiments, one or more switches (e.g., magnetic switches), not shown, can be disposed between the electronic control module 16 and one or both of the pins P1, P2. The magnetic switches may be necessary to convert a low power current from the electronic control module 16 (typically less than 4 amps) to a higher power current (typically 20-30 amps) to allow the pins P1 and P2 to have enough power to effectively control the solenoid windings 127, 129 and 138.

In some embodiments, by including two or more pins, separate amounts of current can be circulated through separate circuits. In some embodiments, pin P1 connects the current source and the secondary solenoid assembly 137 and pin P2 connects the current source and the first and second sets of solenoid windings 127,129. For example, pin P2 can be configured and arranged for a relatively small current load (e.g., 30 amps) so that the first and second sets of solenoid windings 127,129 can receive sufficient current. Moreover, in some embodiments, pin P1 can be configured and arranged for a greater current load (e.g. 40-1000 amps) so that the secondary solenoid assembly 137 can receive sufficient current. Furthermore, by including two or more pins, the first and second solenoid windings 127,129 can receive current independently of the secondary solenoid assembly 137. Additionally, by including two or more pins, the electronic control module 16 can assess and control timing of pinion 150 engagement and motor 170 movement. By way of example only, in some embodiments, the electronic control module 16 can activate pin P1 to begin motor 170 movement and can then activate pin P2 to engage the pinion 150 and ring gear. In other situations, the activation order of the pins P1, P2 and their down-stream components can be reversed and/or performed simultaneously, as described in an exemplary embodiment below.

The following description is intended for illustrative purposes only and is not intended to limit the scope of this disclosure. Some embodiments of this invention can enable a user to regulate operations of the starter 12 via the starter control system 10. In some embodiments, the system 10 can function in response to a signal. For example, the signal can comprise one or more of a starting event in a vehicle in which the vehicle has been stopped and the engine 20 has been inactive for more than a brief period (e.g., a "cold start" starting event), a starting event in a vehicle in which the vehicle continues to be in an active state (e.g., operational) and the engine 20 has been only temporarily inactive (e.g., a "stop-start" starting event), and a starting event in a vehicle in which the vehicle continues to be in an active state (e.g., operational) and the engine 20 has been deactivated, but continues to move (e.g., a "change of mind stop-start" starting event).

In some embodiments, as a result of the electronic control module 16 receiving one or more of the previously mentioned signals, the module 16 can control current flow through the starter control system 10. In some embodiments, the electronic control module 16 can provide a signal to one or both of the pins P1, P2 so that current can flow to the solenoid assembly 125 and/or the secondary solenoid assembly 137. For example, before, after, or during energizing the first and second solenoid windings 127,129, current can flow, via pin P1, to the secondary solenoid assembly 137 to energize the solenoid windings 129 in the secondary solenoid assembly 137 to move the second plunger 140 to close the set of secondary solenoid assembly contacts 139 and enable current flow to the motor. As a result of current flowing to the motor 170, the pinion 150 can begin to rotate.

Moreover, in some embodiments, before, during, or after energizing the secondary solenoid assembly 137, current can flow, via pin P2, to the first and second solenoid windings 127,129 to move the plunger from the first position toward the second position. As a result, during movement of the plunger 135 toward the second position, the coupling member 326 can be at least partially displaced, which can lead to inactivation of the first set of solenoid windings 127. The second set of solenoid windings 129 can continue to move the plunger until disposed in the second position and can further retain the plunger in the second position. Moreover, because of the plunger's movement, the pinion 150 can be moved toward the ring gear 36 of the engine 20, where it can engage the ring gear 36 to start the engine 20.

In some embodiments, one or more sensors 18*a*, 18*b* can be in communication with the electronic control module 16. For example, in some embodiments, a sensor 18*b* can be disposed substantially adjacent to at least a portion of the engine (e.g., the ring gear 36, the crankshaft of the engine 20, etc.) and a sensor can be disposed substantially adjacent to a portion of the starter 12 (e.g., the motor 170, the pinion 150, the gear train 165, etc.). As a result, in some embodiments, the velocity of portions of the starter 12 can be substantially or completely synchronized with portions of the engine 20. By way of example only, the velocity of the ring gear 36 can be substantially or completely synchronized with the velocity of the pinion 150 prior to engagement of these two elements (e.g., via energization of the first and second sets of solenoid windings 127,129 to move the plunger 135 and engage the pinion 150 with the ring gear 36). As a result of the substantial and/or complete synchronization, engagement between the ring gear 36 and pinion 150 can be improved relative to embodiments that lack synchronization. In other embodiments, the engagement between the ring gear 36 and pinion 150 can take place without synchronization provided the relative speeds are below a predetermined threshold.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A starter system comprising:

a starter configured and arranged to be controlled by an electronic control unit, the starter further comprising:

a motor coupled to a starter control circuit, the starter control circuit configured and arranged to be coupled to a current source including a maximum current sufficient to start the motor;

a plunger moveably coupled to a pinion;

a first switch coupled to the circuit and configured and arranged for actuation by the plunger, the first switch comprising at least two contacts configured and arranged for electrical coupling; and wherein electrical coupling of the at least two contacts enables the flow of current through the first switch;

a first solenoid assembly comprising a plunger-return biasing member and at least two solenoid windings including a first and second solenoid winding at least partially circumscribing the plunger, the at least two solenoid windings being configured and arranged to move the plunger to a position and to substantially retain the plunger in a position a secondary solenoid assembly comprising a secondary solenoid winding at least partially circumscribing a secondary plunger, the secondary solenoid winding being configured and arranged to electrically couple with a set of secondary solenoid assembly contacts; and wherein the first solenoid winding is coupled through the first switch; wherein movement of the plunger can disrupt the coupling of the at least two contacts to substantially or completely cease current flow through the first solenoid winding; and wherein the secondary solenoid winding is configured and arranged to move the secondary plunger to couple and decouple with the set of secondary solenoid assembly contacts causing flow of the maximum current to the motor; and wherein based at least in part on the speed of a ring gear of an engine positioned to couple with the pinion, the secondary solenoid winding of the secondary solenoid assembly are configured and arranged to be energized under the control of the electronic control unit before the second solenoid winding of the first solenoid assembly or the first and second solenoid windings of the first solenoid assembly are configured and arranged to be energized before the secondary solenoid winding of the second solenoid assembly.

2. The starter system of claim 1, wherein the first switch further comprises at least one coupling member configured and arranged for electrical coupling of the at least two contacts; and wherein the at least one coupling member is configured and arranged to be moved by the plunger and decoupled from at least one of the at least two contacts.

3. The starter system of claim 2, wherein the at least one coupling member is configured and arranged to be rotatably moved by the plunger, wherein movement of the at least one coupling member can control current flow through the first switch.

4. The starter system of claim 2, wherein the at least one coupling member is configured and arranged to be moved axially by the plunger and wherein movement of the at least one coupling member can control current flow through the first switch.

5. The starter system of claim 1, wherein the movement of the plunger and coupling with the at least two contacts enables the flow of current through the first switch; and wherein movement of the plunger and decoupling from at least one of the at least two contacts prevents the flow of current through the first switch.

6. The starter system of claim 1, wherein the resistance of the second solenoid winding is greater than the resistance of the first solenoid winding.

7. The starter system of claim 1, wherein a coupling of the secondary plunger and the secondary solenoid assembly contacts causes at least a portion of the circuit to enable current to flow to the motor.

8. The starter system of claim 1, wherein the secondary solenoid assembly is configured and arranged for communication with the electronic control unit.

9. The starter system of claim 1, wherein the first solenoid assembly is configured and arranged for communication with the electronic control unit.

10. The starter system of claim 2, wherein the starter control circuit further comprises at least one pin coupled to the circuit and configured and arranged for receiving a signal from the electronic control unit.

11. The starter of control system of claim 10, wherein the at least one other component in the circuit is the motor.

12. The starter control system of claim 10, wherein the circuit further comprises a switch electrically coupled to the at least one pin, wherein the first switch is configured and arranged for electrical communication with an electronic control unit.

13. The starter control system of claim 12, wherein the first switch comprises a magnetic switch.

14. The starter system of claim 10, wherein the at least one pin comprises a first pin and a second pin, wherein the first pin is coupled to the first solenoid assembly and the second pin is coupled to a secondary solenoid assembly.

15. The starter system of claim 14, wherein the first pin and the second pin are configured and arranged so that the flow of current through the first pin is independent of the flow of current through the second pin and the flow of current through the second pin is independent of the flow of the flow of current through the first pin.

16. The starter system of claim 1, wherein the first solenoid assembly further comprises a second solenoid winding wherein the first solenoid winding is configured and arranged to move the plunger to a position and the second solenoid winding is configured and arranged to substantially retain the plunger in the position.

17. The starter system of claim 16, wherein the second solenoid winding is further configured and arranged to move the plunger to the first position.

18. A starter system comprising:

a starter configured and arranged for being controlled by an electronic control unit, the starter further comprising:

a motor coupled to a starter control circuit, the starter control circuit configured and arranged to be coupled to a current source including a maximum current sufficient to start the motor;

a plunger moveably coupled to a pinion;

wherein the electronic control unit configured to engage the pinion with a ring gear while the ring gear is coasting;

a first switch coupled to the circuit and configured and arranged for actuation by the plunger, the first switch comprising at least two contacts configured and arranged for electrical coupling; and wherein electrical coupling of the at least two contacts enables the flow of current through the switch;

a first solenoid assembly comprising a plunger-return biasing member and at least two solenoid windings at least partially circumscribing the plunger, the at least two solenoid windings being configured and arranged to move the plunger to a position and to substantially retain the plunger in the position, the first solenoid assembly including a first solenoid winding being coupled through the first switch wherein movement of the plunger can disrupt the coupling of the at least two contacts to substantially or completely cease current flow through the first solenoid winding; and a secondary solenoid assembly comprising a secondary solenoid winding at least partially circumscribing a secondary plunger, the secondary solenoid winding being configured and arranged to electrically couple with a set of secondary solenoid assembly contacts causing flow of the maximum current to the motor; and wherein based at least in part on the speed of a ring gear of an engine positioned to couple with the pinion, the secondary solenoid winding of the secondary solenoid assembly are configured and arranged to be energized before the second solenoid winding of the first solenoid assembly or the first and second solenoid windings of the first solenoid assembly are configured and arranged to be energized before the secondary solenoid winding of the second solenoid assembly.

19. The starter system of claim 18, wherein the first switch further comprises at least one coupling member configured and arranged for electrical coupling of the at least two contacts; and wherein the at least one coupling member is configured and arranged to be moved by the plunger and decoupled from at least one of the at least two contacts; and wherein the movement of the plunger and coupling with the at least two contacts enables the flow of current through the first switch and movement of the plunger, and decoupling from at least one of the at least two contacts prevents the flow of current through the first switch.

20. The starter system of claim 19, wherein the secondary solenoid winding is configured and arranged to move the secondary plunger to couple with the set of secondary solenoid assembly contacts causing at least a portion of a current to flow to the motor.

21. The starter system of claim 19, wherein the first solenoid assembly includes a second solenoid winding configured and arranged to retain the plunger in a position; and wherein the first solenoid winding is configured and arranged to substantially move the plunger to a position.

* * * * *